US008047825B2

(12) United States Patent
Cooper et al.

(10) Patent No.: US 8,047,825 B2
(45) Date of Patent: Nov. 1, 2011

(54) FLUOROPOLYMER-CONTAINING FILMS FOR USE WITH POSITIVE-DISPLACEMENT FLUID PUMPS

(75) Inventors: Clark V. Cooper, Arlington, VA (US); Aaron T. Nardi, East Granby, CT (US)

(73) Assignee: United Technologies Corporation, Hartford, CT (US)

( * ) Notice: Subject to any disclaimer, the term of this patent is extended or adjusted under 35 U.S.C. 154(b) by 922 days.

(21) Appl. No.: 11/784,680

(22) Filed: Apr. 9, 2007

(65) Prior Publication Data

US 2008/0247896 A1 Oct. 9, 2008

(51) Int. Cl.
*F01C 21/00* (2006.01)
*F01C 1/18* (2006.01)

(52) U.S. Cl. ..... 418/206.9; 418/178; 418/179

(58) Field of Classification Search ..... 418/206.1, 418/178, 179, 206.9; 29/888.023
See application file for complete search history.

(56) References Cited

U.S. PATENT DOCUMENTS

| | | | | |
|---|---|---|---|---|
| 2,966,860 | A | 1/1961 | Maynard | |
| 3,460,481 | A * | 8/1969 | White, Jr. | 418/178 |
| 3,652,409 | A * | 3/1972 | Mack et al. | 508/106 |
| 3,674,689 | A * | 7/1972 | Giltrow et al. | 428/298.7 |
| 4,362,480 | A * | 12/1982 | Suzuki et al. | 418/178 |
| 4,571,165 | A | 2/1986 | Murata | |
| 4,583,924 | A | 4/1986 | Zengelein | |
| 5,024,591 | A | 6/1991 | Nakajima | |
| 5,199,722 | A * | 4/1993 | Wada et al. | 277/434 |
| 5,240,775 | A | 8/1993 | Tannenbaum | |
| 5,250,356 | A | 10/1993 | Batzar | |
| 5,364,248 | A * | 11/1994 | Nakashima et al. | 418/178 |
| 5,364,250 | A * | 11/1994 | Aoki et al. | 418/178 |
| 5,399,434 | A | 3/1995 | Katz et al. | |
| 5,772,182 | A | 6/1998 | Stambaugh, Sr. et al. | |
| 5,993,183 | A | 11/1999 | Laskaris et al. | |
| 6,210,138 | B1 | 4/2001 | Cortez | |
| 6,821,099 | B2 * | 11/2004 | Wilk et al. | 418/259 |
| 7,040,873 | B2 | 5/2006 | Dooley | |
| 7,043,896 | B2 | 5/2006 | Matthews | |
| 7,100,378 | B2 | 9/2006 | Matthews | |
| 7,174,997 | B2 | 2/2007 | Sheridan | |
| 2004/0221715 | A1 | 11/2004 | Murase | |
| 2006/0133919 | A1 | 6/2006 | Dooley | |
| 2007/0000560 | A1 | 1/2007 | Jaworowski | |
| 2008/0025861 | A1 * | 1/2008 | Okawa et al. | 418/178 |

FOREIGN PATENT DOCUMENTS

| | | | |
|---|---|---|---|
| DE | 3916858 | A1 * | 11/1990 |
| EP | 1612425 | | 1/2006 |
| GB | 1329969 | | 9/1973 |
| WO | WO 2006035680 | A1 * | 4/2006 |

OTHER PUBLICATIONS

Official Search Report of the European Patent Office in counterpart Application No. EP08251035 mailed Jul. 29, 2008.

* cited by examiner

*Primary Examiner* — Mary A Davis
(74) *Attorney, Agent, or Firm* — Kinney & Lange, P.A.

(57) ABSTRACT

A positive-displacement pump comprising a housing, a rotatable component disposed at least partially within the housing, and a film disposed at least partially between the housing and the rotatable component, where the film comprises a reinforcing material and a fluoropolymer material.

17 Claims, 4 Drawing Sheets

FLUOROPOLYMER-CONTAINING FILMS FOR USE WITH POSITIVE-DISPLACEMENT FLUID PUMPS

BACKGROUND

The present invention relates to positive-displacement fluid pumps, such as a rotary gear pumps and rotary vane pumps. In particular, the present invention relates to protective coatings for use in positive-displacement fluid pumps.

Positive-displacement fluid pumps are fluid transfer equipment employed in a variety of industrial and commercial systems for pumping fluids from one location to another. For example, positive-displacement fluid pumps may be used in aircraft to pump fuel from storage reservoirs to turbine engines during flight. Such pumps typically include rotary components (e.g., rotatable gears) that rotate within a housing to transfer the fluids. To increase pumping efficiencies, the rotary components are retained as close as reasonably possible to the housing to reduce leaks. However, this can induce abrasive or adhesive wearing of the rotary components and the housings during the course of operation.

One technique for reducing the rate of wearing includes the use of side or end plates composed of monolithic-cemented carbide or case-hardened steel. The side and end plates are correspondingly subjected to wear, thereby reducing damage to the rotary components and the housings. However, such materials can increase frictional resistance between the rotary components and the housing, which can reduce pumping efficiencies, and potentially cause metal-to-metal seizures.

Another option includes the use of side or end plates having steel or aluminum substrates coated with a leaded-bronze, sacrificial material (or the plates are solid leaded-bronze). The lead in the sacrificial material is capable of smearing around the steel substrate rather than being worn down. However, because of potential environmental and health concerns associated with the manufacture and use of lead, leaded-bronze materials are falling into disfavor. As such, there is a need for a protective coating that avoids the potential health concerns associated with lead-containing materials, but retains the positive properties of leaded-bronze materials.

SUMMARY

The present invention relates to a positive-displacement pump that includes a housing and a rotary component disposed at least partially within the housing. The positive-displacement pump also includes a film disposed at least partially between the housing and the rotary component, where the film includes a reinforcing material and a fluoropolymer material.

DETAILED DESCRIPTION

Figure 1:
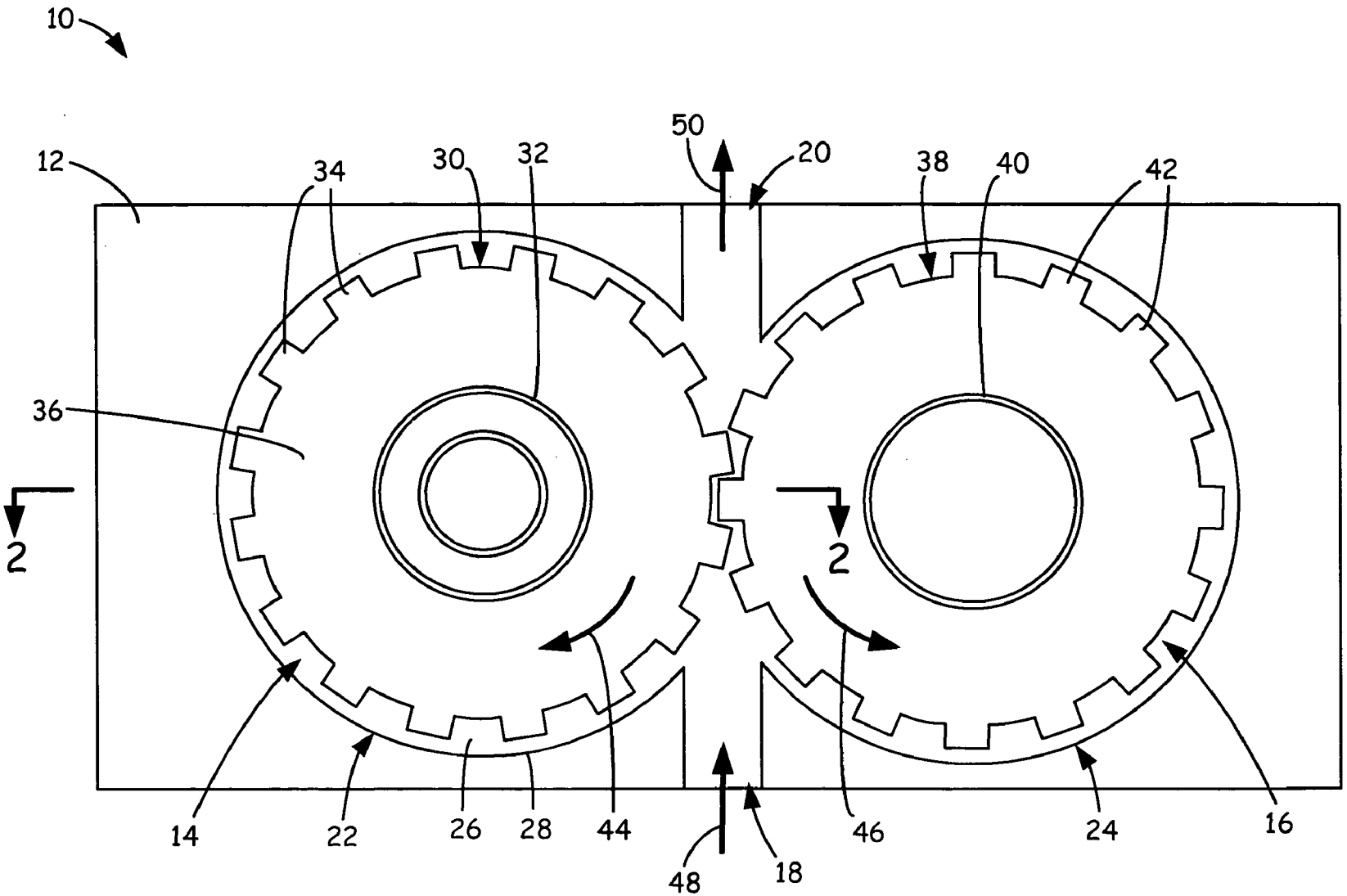
FIG. 1 is a cutaway top view of a rotary gear pump, where a top half of a housing is omitted, and in which meshing spur gears are elements of an external gear pump of the positive-displacement type.

FIG. 1 is a top view of rotary gear pump 10, which is an example of a positive-displacement pump of the present invention. Pump 10 includes housing 12, drive rotor 14, and driven rotor 16, where a top portion of housing 12 is omitted for clarity. Housing 12 defines entrance channel 18, exit channel 20, drive chamber 22, and driven chamber 24. As shown, drive chamber 22 includes base wall 26 and lateral wall 28, where base wall 26 is a surface disposed below drive rotor 14, and lateral wall 28 is a surface that extends circumferentially around drive rotor 14.

Drive rotor 14 includes drive gear 30 and drive shaft 32, where drive gear 30 includes gear teeth 34 and top face 36. Gear teeth 34 are a plurality of teeth extending circumferentially around drive gear 30. Top face 36 is a top major surface of drive gear 30 that is at least partially covered with a protective film. As discussed below, the protective film reduces the amount of abrasive wearing incurred by drive chamber 22 and drive gear 30 during operation, thereby extending the operational life of pump 10. Drive shaft 32 extends axially through drive gear 30, thereby mounting drive gear 30 within drive chamber 22. Drive shaft 32 is also secured, directly or indirectly, to a motor (not shown) for rotating drive shaft 32, and correspondingly, drive gear 30.

Driven rotor 16 includes driven gear 38 and driven shaft 40, where driven gear 38 includes gear teeth 42. Gear teeth 42 are a plurality of teeth extending circumferentially around driven gear 38. Driven shaft 40 extends axially through driven gear 38, thereby mounting driven gear 38 within driven chamber 24. Driven shaft 40 is a free-rotating shaft, thereby allowing driven gear 38 to be rotated by drive gear 30.

As shown, gear teeth 34 of drive gear 30 engage gear teeth 42 of driven gear 38 at a location between entrance channel 18 and exit channel 20. This engagement desirably minimizes fluid flow directly between entrance channel 18 and exit channel 20. During operation, drive shaft 32 is rotated by the external motor, thereby rotating drive gear 30 in the direction of arrow 44. Due to the engagement between gear teeth 34 and 42, the rotation of drive gear 30 in the direction of arrow 44 correspondingly rotates driven gear 38 in the direction of arrow 46. As fluid is introduced into entrance channel 18 (represented by arrow 48), the rotation of drive gear 30 and driven gear 38 carries the fluid around drive chamber 22 and driven chamber 24, respectively. In particular, drive gear 30 carries a first portion of the fluid in a circular path around drive chamber 22, and driven gear 38 carries a second portion of the fluid in a circular path around driven chamber 24. When the first and second potions of the fluid respectively exit drive chamber 22 and driven chamber 24, the first and second portions reunite and exit housing 12 through exit channel 20 (represented by arrow 50).

Figure 2:
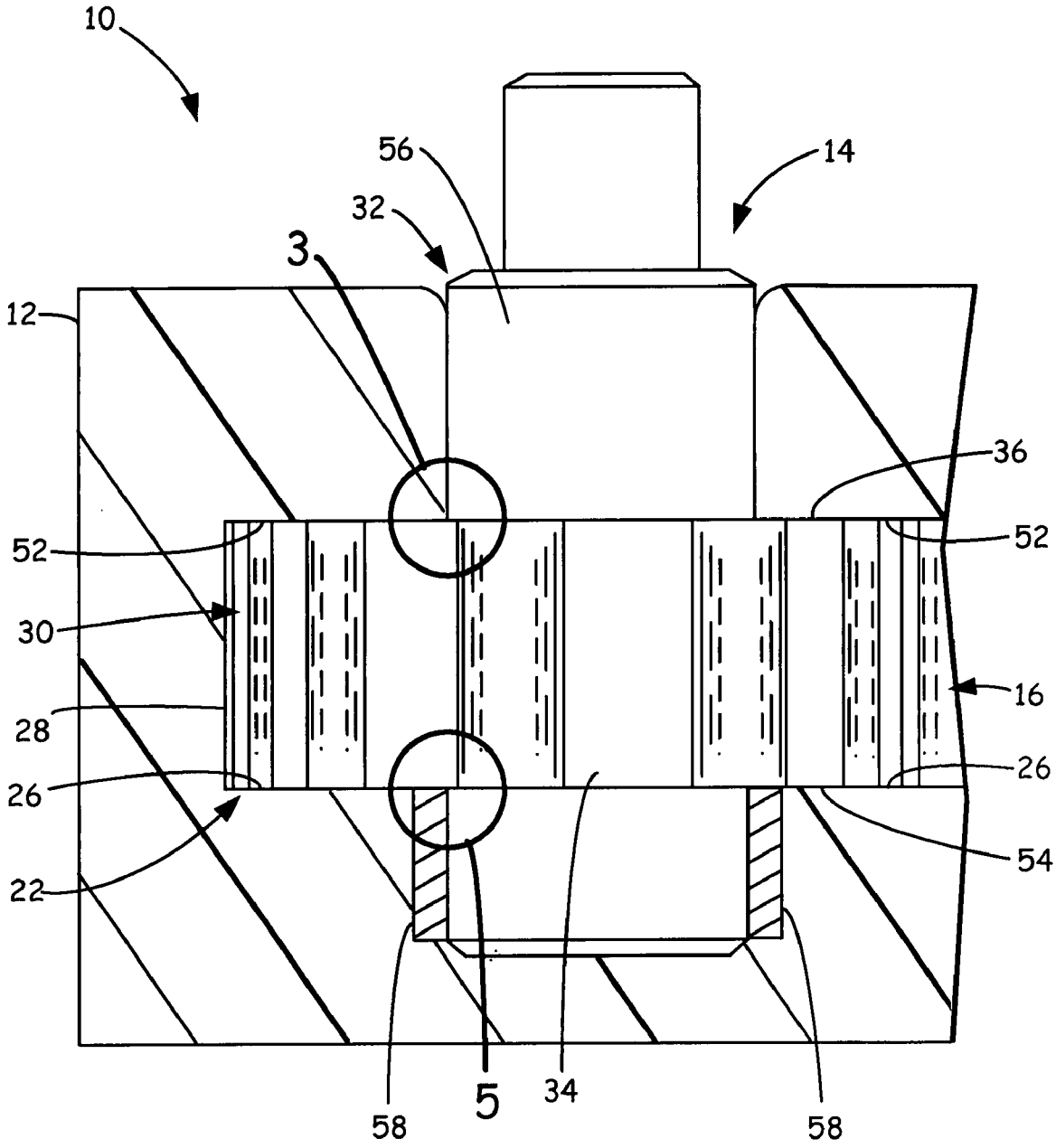
FIG. 2 is a partial sectional view of section 2-2 taken in FIG. 1, in which the top half of the housing is shown.

FIG. 2 is a partial sectional view of section 2-2 taken in FIG. 1, where housing 12 is shown in section. As shown, drive chamber 22 also includes top wall 52, which is the opposing surface of drive chamber 22 from base wall 26, and which faces top face 36 of drive gear 30. Drive gear 30 also includes bottom face 54, which is the opposing major surface of drive gear 30 from top face 36 (i.e., a bottom major surface), and which is at least partially covered with a second protective film. As discussed below, the second protective film reduces the friction coefficient (frictional losses) and the amount of abrasive wearing incurred by bottom surface 26 of drive chamber 22 and drive gear 30 during operation. Drive shaft 32 includes outer diameter (OD) surface 56 disposed within housing 12.

Housing 12 also includes bearings set 58 (shown in section), which is a set of journal bearings for stabilizing the rotation of drive rotor 14. As shown, bearings set 58 is disposed around drive shaft 32 at a location below drive gear 30. In an alternative embodiment, housing 12 also includes an additional bearings set (not shown) around drive shaft 32, at a location above drive gear 30.

Drive rotor 14 is desirably positioned within housing 12 such that top face 36 contacts top wall 52, and such that bottom face 54 contacts bottom surface 26. This provides seals between drive gear 30 and drive chamber 22, which minimizes fluid leakage. Driven rotor 16 also includes a similar arrangement. The seals increase the efficiency of pump 10 to transfer fluids from entrance channel 18 (shown in FIG. 1) to exit channel 20 (shown in FIG. 1). However, the seals also increase the risk of frictionally rubbing top face 36 and bottom face 54 of drive gear 30 respectively against top wall 52 and base wall 26 of drive chamber 22. This is particularly true for base wall 26 of drive chamber 22 and bottom face 54 of drive gear 30. Drive shafts of rotary pumps (e.g., drive shaft 32) typically have thrust loads hydraulically applied to them, which biases the drive shafts downward into the housings (e.g., housing 12). However, as discussed below, the protective films of top face 36 and bottom face 54 protect drive chamber 22 and drive gear 30 during operation.

Figure 3:
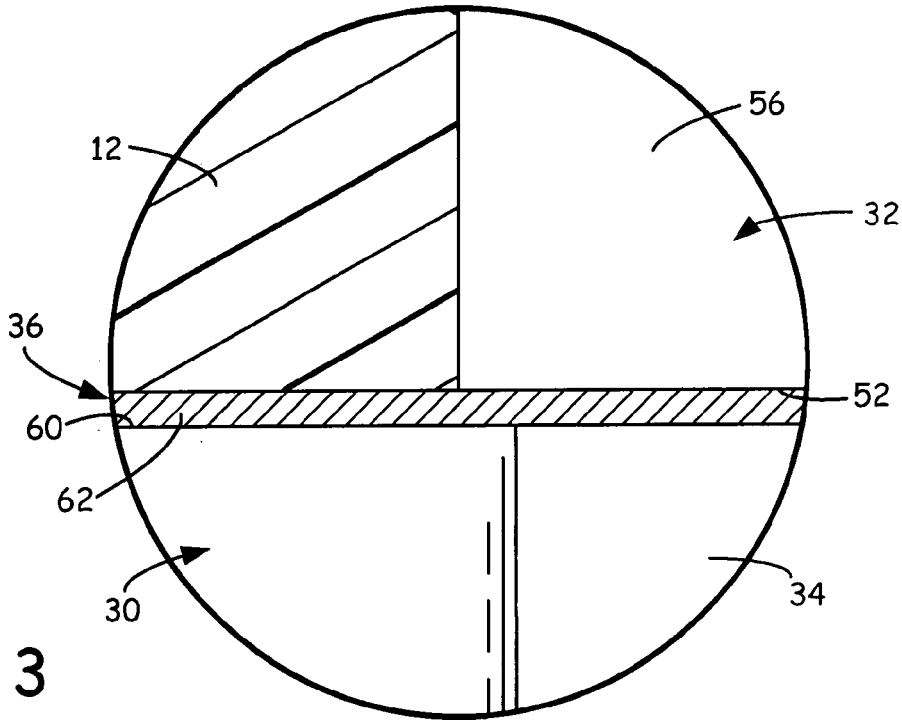
FIG. 3 is an expanded view of section 3 taken in FIG. 2, further illustrating a top face of a drive gear, where the top face includes a protective film over a top major surface of the drive gear.

FIG. 3 is an expanded view of section 3 taken in FIG. 2, further illustrating top face 36 of drive gear 30. As shown, top face 36 includes top major surface 60 and protective film 62. Top major surface 60 is the top surface of drive gear 30, and protective film 62 is secured to top major surface 60 over at least a portion of the surface area of top major surface 60. In one embodiment, protective film 62 covers the entire surface area of top major surface 60, including gear teeth 34.

Protective film 62 compositionally includes a reinforcing material interdispersed with a fluoropolymer material. While drive gear 38 rotates, protective film 62 is the portion of top face 36 that frictionally rubs against top wall 52 of drive chamber 22. As such, protective film 62 is a sacrificial layer that is slowly eroded away over extended periods of operation. However, while present, protective film 62 prevents housing 12 and drive gear 30 from directly contacting, thereby reducing the amount of abrasive wearing incurred by housing 12 and drive gear 30. Protective film 62 is particularly suitable during start-up of pump 10, where a spike in frictional force may occur because the seals between drive chamber 22 and drive gear 30 have not obtained hydrodynamic states.

The reinforcing material of protective film 62 is a wear-resistant, porous material that retains the fluoropolymer material. The fluoropolymer material reduces the friction between top wall 52 of drive chamber 22 and top major surface 60, and smears across top major surface 60 under the applied friction. As a result, the fluoropolymer material lubricates top wall 52 and top major surface 60 by material transfer in a similar manner to lead-based materials. However, the fluoropolymer material does not exhibit the potential environmental and health concerns associated with the manufacture and use of lead. As such, protective film 62 avoids the potential health concerns associated with lead-containing materials, while retaining the positive properties of leaded-bronze materials.

In an alternative embodiment, protective film 62 is secured over top wall 52 of drive chamber 22, rather than over top major surface 60. In this embodiment, protective film 62 functions in the same manner as discussed above for reducing the friction between top wall 52 and top major surface 60. Accordingly, protective film 62 may be secured to different surfaces such that protective film 62 is at least partially disposed between top wall 52 and top major surface 60.

Figure 4:
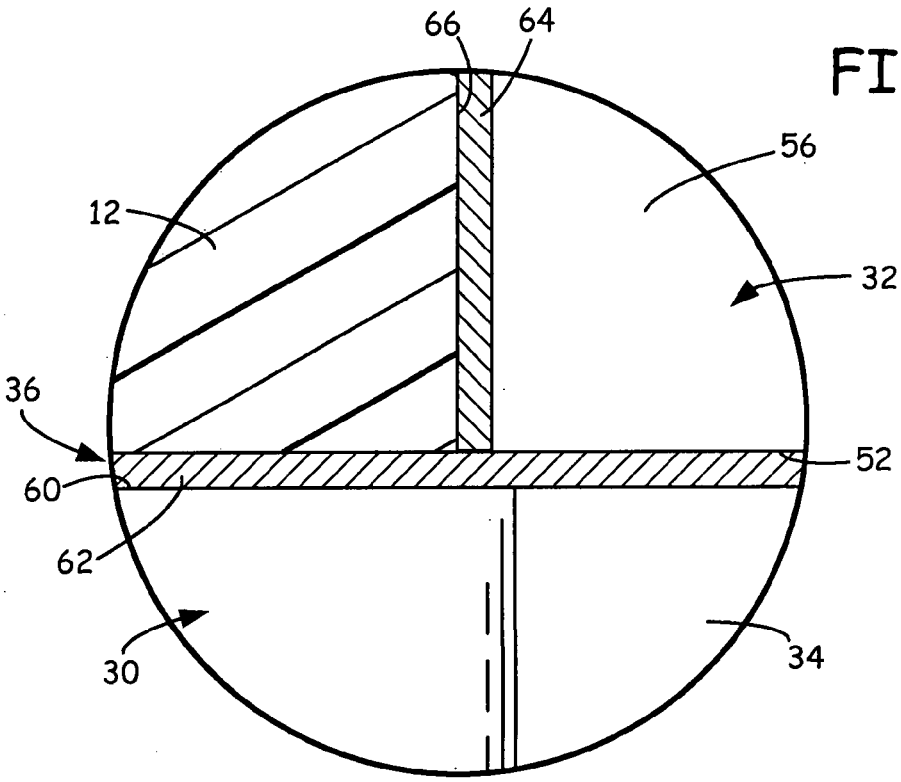
FIG. 4 is an alternative expanded view of section 3 taken in FIG. 2, further illustrating a second protective film secured to an outer-diameter surface of a drive shaft, above the drive gear.

FIG. 4 is an alternative expanded view of section 3 taken in FIG. 2, which depicts an alternative embodiment that further includes protective film 64 secured over at least a portion of OD surface 56 of drive shaft 32. In one embodiment, protective film 64 covers the entire surface area of OD surface 56. Thus, protective film 64 is disposed between OD surface 56 and a circumferential surface of housing 12 (referred to as housing surface 66). Protective film 64 is compositionally the same as, and functions in the same manner as, protective film 62 for reducing the friction between OD surface 56 and housing surface 66. Thus, protective film 64 reduces the amount of abrasive wearing incurred by housing 12 and drive shaft 32.

In another alternative embodiment, protective film 64 is secured over housing surface 66 of housing 12, rather than over OD surface 56 of drive shaft 32. In this embodiment, protective film 64 functions in the same manner as discussed above for reducing the friction between OD surface 56 and housing surface 66.

Figure 5:
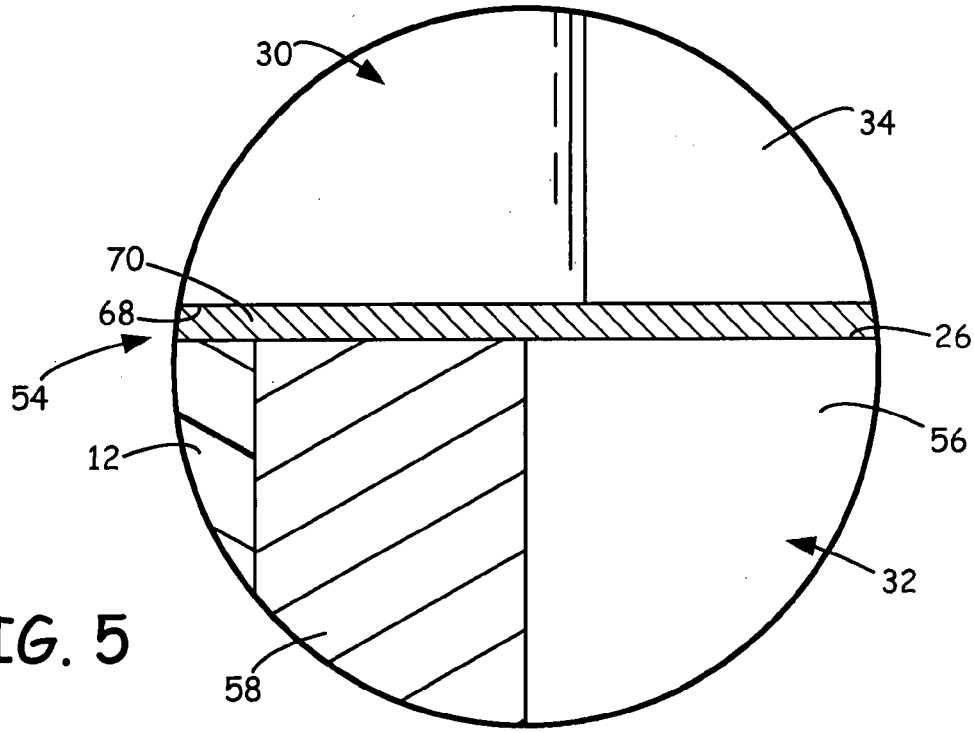
FIG. 5 is an expanded view of section 5 taken in FIG. 2, further illustrating a bottom face of the drive gear, where the bottom face includes a third protective film over a bottom major surface of the drive gear.

FIG. 5 is an expanded view of section 5 taken in FIG. 2, further illustrating bottom face 54 of drive gear 30. As shown, bottom face 54 includes bottom major surface 68 and protective film 70. Bottom major surface 68 is the bottom surface of drive gear 30, and protective film 70 is secured to bottom major surface 68 over at least a portion of the surface area of bottom major surface 68. In one embodiment, protective film 70 covers the entire surface area of bottom major surface 68, including gear teeth 34.

Protective film 70 is compositionally the same as, and functions in the same manner as, protective film 62 (shown in FIGS. 3 and 4) for reducing the friction between base wall 26 of drive chamber 22 and bottom major surface 68 of drive gear 30. In an alternative embodiment, protective film 70 is secured over base wall 26 of drive chamber 22, rather than over bottom major surface 68. In this embodiment, protective film 70 functions in the same manner as discussed above for reducing the friction between base wall 26 and bottom major surface 68.

Figure 6:
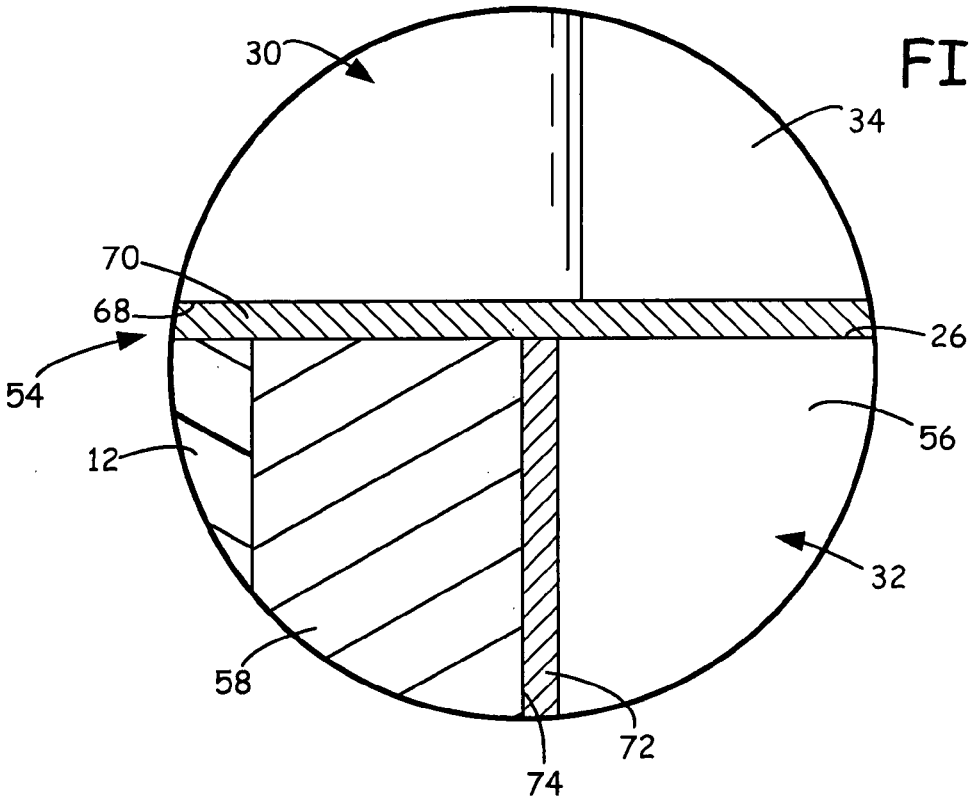
FIG. 6 is an alternative expanded view of section 5 taken in FIG. 2, further illustrating a fourth protective film secured to an outer-diameter surface of a drive shaft, below the drive gear.

FIG. 6 is an alternative expanded view of section 5 taken in FIG. 2, which depicts an alternative embodiment that further includes protective film 72 secured over at least a portion of OD surface 56 of drive shaft 32, below drive gear 30. In one embodiment, protective film 72 covers the entire surface area of OD surface 56. Thus, protective film 72 is disposed between OD surface 56 and a circumferential surface of bearings set 58 (referred to as journal surface 74). Protective film 72 is compositionally the same as, and functions in the same manner as, protective film 62 (shown in FIGS. 3 and 4) for reducing the friction between OD surface 56 and journal surface 74. Thus, protective film 72 reduces the amount of abrasive wearing incurred by housing 12 and drive shaft 32.

In another alternative embodiment, protective film 72 is secured over journal surface 74, rather than over OD surface 56 of drive shaft 32. In this embodiment, protective film 72 functions in the same manner as discussed above for reducing the friction between OD surface 56 and journal surface 74.

As discussed above, protective films 62, 64, 70, and 72 are each coatings that compositionally include a reinforcing material interdispersed with a fluoropolymer material. Suitable reinforcing materials for use in the composition include metal particles (e.g., aluminum, copper, tin, and alloys thereof), carbon-based fibers (e.g., carbon graphite fibers), aromatic polyamide fibers, glass particles, ceramic particles, and combinations thereof. The reinforcing material is also desirably substantially free of heavy metals (e.g., lead), thereby reducing the risk of potential environmental and health concerns. Examples of suitable concentrations of the reinforcing material in the composition range from about 50% by volume to about 95% by volume, with particularly suitable concentrations ranging from about 70% by volume to about 80% by volume.

Suitable fluoropolymer materials for use in the composition include any fluoropolymer capable of providing lubrication by material transfer, such as polytetrafluoroethylenes (PTFEs), fluorinated ethylenepropylene (FEP) copolymers, and combinations thereof. Examples of a particularly suitable fluoropolymer material includes a 50/50 (by volume) blend of a polyamide-FEP and a polyimide-PTFE. Examples of suitable concentrations of the fluoropolymer material in the composition range from about 5% by volume to about 50% by volume, with particularly suitable concentrations ranging from about 20% by volume to about 30% by volume.

The protective films (e.g., protective films 62, 64, 70, and 72) may each be formed by depositing one or more layers of the reinforcing material onto the appropriate surface (e.g., top major surface 60). The reinforcing material may be deposited in a variety of manners, such as with a powder deposition system. The coated component is then soaked in a mixture containing the fluoropolymer material (e.g., a dispersion, emulsion, and/or a suspension of the fluoropolymer material in a carrier fluid). During the soaking process, the mixture migrates into and fills the porous regions of the reinforcing material. The soaking process is desirably performed under a vacuum or reduced pressure to remove entrained gases from the porous regions of the reinforcing material. After a suitable duration for filling the porous regions (e.g., 1-3 hours), the coated component is then dried to form a protective film (e.g., protective film 62) on a corresponding surface (e.g., top major surface 60).

The film thicknesses of protective films 62, 64, 70, and 72 may vary depending on design criteria required to provide suitable seals. Examples of suitable film thicknesses for each of protective films 62, 64, 70, and 72 range from about 5 micrometers to about 1,000 micrometers, with particularly suitable film thicknesses ranging from about 10 micrometers to about 100 micrometers.

After formation, protective films 62, 64, 70, and 72 may also undergo one or more post-processing techniques, such as smoothing, radiation exposure, vacuum aging, and combinations thereof. Smoothing processes are suitable for providing uniform thicknesses of a given protective film, and for obtaining a desired film thickness. Radiation exposure and vacuum aging are beneficial for improving the physical properties of the fluoropolymer material. The heat generated by the radiation exposure and vacuum aging cause portions of the fluoropolymer material to at least partially cross link, thereby increasing the durability of the protective films.

Radiation exposure involves exposing the protective film to actinic radiation for a suitable duration. Examples of suitable types of actinic radiation for the radiation exposure include those having wavelengths ranging from gamma-rays to ultraviolet (UV) wavelengths (e.g., gamma, x-ray, and UV), electron beam radiation, and combinations thereof. Suitable durations for the radiation exposure generally depend on the wavelength and the power or power density of the actinic radiation being utilized. Examples of suitable durations for the radiation exposure range from about 1 second to about 100 minutes, with particularly suitable durations ranging from about 1 second to about 60 seconds.

Vacuum aging involves exposing the protective film to one or more elevated temperatures under a vacuum or reduced pressure to minimize the exposure to oxygen. Suitable temperatures for vacuum aging generally depend on the polymeric composition of the protective film. Examples of suitable temperatures for vacuum aging range from about 65° C. (about 150° F.) to about 260° C. (about 500° F.), with particularly suitable temperatures ranging from about 100° C. (about 210° F.) to about 250° C. (about 480° F.). Suitable durations for the vacuum aging range from about 10 minutes to about 9 hours, with particularly suitable durations ranging from about 1 hour to about 5 hours.

In one embodiment, the protective films (e.g., protective films 62, 64, 70, and 72) undergo a radiation exposure process at an elevated temperature and under vacuum or reduced pressure. This increases the physical properties of the fluoropolymer material while also minimizing the exposure of the protective films to oxidizing environments. After the post-processing, the components containing the protective films (e.g., drive gear 30) may be assembled to form pump 10 (shown in FIGS. 1 and 2).

Although the present invention has been described with reference to preferred embodiments, workers skilled in the art will recognize that changes may be made in form and detail without departing from the spirit and scope of the invention. For example, while the above-discussed protective films (e.g., protective films 62, 64, 70, and 72) are used with drive chamber 22 and/or drive rotor 14, similar protective films may be used with the corresponding components of driven chamber 24 and/or driven rotor 16. Additionally, while pump 10 is illustrated as an external-gear positive displacement pump, the present invention is also suitable for use with positive displacement pumps of other designs, such as internal-gear positive displacement pumps. Moreover, while drive gear 30 and driven gear 38 are depicted as intermeshing spur gears, the present invention is also suitable for use with gear pumps that contain other types of gears (e.g., helical and herringbone-type gears).

The invention claimed is:

1. A positive-displacement pump comprising:

a housing;

a rotatable component disposed at least partially within the housing; and a film disposed at least partially between the housing and the rotatable component, the film comprising a reinforcing material selected from the group consisting of copper and copper alloys and a fluoropolymer material in a polymer matrix selected from the group consisting of polyamide-fluorinated ethylenepropylene copolymers, polyimide-polytetrafluoroethylenes, and combinations thereof, wherein the reinforcing material is present in the film at a concentration ranging from 50% by volume to 95% by volume.

2. The positive-displacement pump of claim 1, wherein the rotatable component is selected from the group consisting of a drive gear, a driven gear, a drive shaft, and a driven shaft.

3. The positive-displacement pump of claim 1, wherein the film further comprises carbon-based fibers, aromatic polyamide fibers, glass particles or ceramic particles.

4. The positive-displacement pump of claim 1, wherein the concentration of the fluoropolymer material in a polymer matrix in the film ranges from 20% by volume to 30% by volume.

5. The positive-displacement pump of claim 4, wherein the concentration of the reinforcing material ranges from 70% by volume to 80% by volume.

6. The positive-displacement pump of claim 1, wherein the fluoropolymer material in a polymer matrix is present in the film at a concentration ranging from 5% by volume to 50% by volume.

7. A positive-displacement pump comprising:

a housing;

a rotatable component disposed at least partially within the housing; and a film disposed at least partially between the housing and the rotatable component, the film comprising:

a reinforcing material selected from the group consisting of copper and copper alloys; and a fluoropolymer material in a polymer matrix comprising:

a polyamide-fluorinated ethylenepropylene copolymer.

8. The positive-displacement pump of claim 7, wherein the fluoropolymer material in a polymer matrix further comprises:

a polyimide-polytetrafluoroethylene.

9. The positive-displacement pump of claim 8, wherein the reinforcing material is present in the film at a concentration ranging from 50% by volume to 95% by volume.

10. The positive-displacement pump of claim 8, wherein the fluoropolymer material in a polymer matrix comprises 50% polyamide-fluorinated ethylenepropylene copolymer by volume and 50% polyimide-polytetrafluoroethylene by volume.

11. The positive-displacement pump of claim 7, wherein the reinforcing material is present in the film at a concentration ranging from 50% by volume to 95% by volume.

12. A positive-displacement pump comprising:

a housing having an inner wall;

a rotatable component disposed at least partially within the housing, and having a surface facing the inner wall of the housing; and a film disposed at least partially between the inner wall of the housing and the surface of the rotatable component, the film comprising a reinforcing material selected from the group consisting of copper and copper alloys and a fluoropolymer material in a polymer matrix selected from the group consisting of polyamide-fluorinated ethylenepropylene copolymers, polyimide-polytetrafluoroethylenes, and combinations thereof, wherein the reinforcing material is present in the film at a concentration ranging from 50% by volume to 95% by volume.

13. The positive-displacement pump of claim 12, wherein the rotatable component comprises a gear, and wherein the surface of the rotatable component comprises a major surface of the gear.

14. The positive-displacement pump of claim 12, wherein the rotatable component comprises a shaft, and wherein the surface of the rotatable component comprises an outer diameter surface of the shaft.

15. The positive-displacement pump of claim 12, wherein the film is secured to the surface of the rotatable component.

16. The positive-displacement pump of claim 12, wherein the film is secured to the inner wall of the housing.

17. The positive-displacement pump of claim 12, wherein the inner wall of the housing is a first inner wall, the surface of the rotatable component is a first surface, and the film is a first film, and wherein the positive-displacement pump further comprises a second film disposed at least partially between a second inner wall of the housing and a second surface of the rotatable component, the second film comprising a second reinforcing material and a second fluoropolymer material in a polymer matrix selected from the group consisting of polyamide-fluorinated ethylenepropylene copolymers, polyimide-polytetrafluoroethylenes, and combinations thereof.

* * * * *